US005183496A

United States Patent [19]

Blenk et al.

[11] Patent Number: 5,183,496

[45] Date of Patent: Feb. 2, 1993

[54] COPPER SPEISS AS A CO-ADDITIVE IN REFINING CRUDE LEAD BULLION

[75] Inventors: Michael H. Blenk, Youngstown, N.Y.; Russell B. Diemer, Jr., Hockessin, Del.; John P. Hager, Golden, Colo.

[73] Assignee: E. I. Du Pont de Nemours and Company, Wilmington, Del.

[21] Appl. No.: 835,649

[22] Filed: Feb. 13, 1992

[51] Int. Cl.[5] ..... C22B 13/06

[52] U.S. Cl. ..... 75/702

[58] Field of Search ..... 75/701, 702

[56] References Cited

U.S. PATENT DOCUMENTS 2,110,445 3/1938 Lefferrer .
2,765,328 10/1956 Padgitt .
4,033,761 7/1977 Di Martini et al. .
4,153,451 5/1979 Crasto et al. .
4,333,763 6/1982 Di Martini et al. .
4,404,026 9/1983 Di Martini et al. .
5,100,466 3/1992 Blenk ..... 75/702

FOREIGN PATENT DOCUMENTS 0007890 2/1980 European Pat. Off. ..... 75/702
357245 1/1973 U.S.S.R. .

OTHER PUBLICATIONS

"Sodium Treatment of Copper Dross", C. Bates and C. Di Martini Journal of Metals, Aug. 1986, pp. 43–45.
"Process for Separating Impurities from Crude Lead Bullion Via Sodium Metal Injection", M. B. Blenk, R. B. Diemer and J. P. Hager, International Symposium on Injection in Process Metallurgy, Feb. 21, 1991.

*Primary Examiner*—Melvyn J. Andrews
*Attorney, Agent, or Firm*—Charles E. Krukiel

[57] ABSTRACT

Previously formed copper speiss in an amount of about 6.5% by weight is a co-additive which extends the usefulness of sodium in refining crude lead bullion, which has a sulfur content generally less than about 1.3% by weight.

4 Claims, No Drawings

COPPER SPEISS AS A CO-ADDITIVE IN REFINING CRUDE LEAD BULLION

BACKGROUND OF THE INVENTION

The present invention relates to an improved process for concentrating elemental lead in crude lead bullion, and, more particularly, to an improved process involving sodium addition to molten bullion at a temperature of at least about 750° C. but not higher than the boiling point of sodium followed by controlled solidification of the resulting mixture to substantially separate a matte equilibrium phase and a copper speiss equilibrium phase from a lead bullion equilibrium phase, the improvement comprising adding previously isolated copper speiss to the molten crude lead bullion prior to or substantially simultaneously with the sodium whereby formation of the equilibrium phases is enhanced. The present invention is particularly applicable for separating elemental lead from relatively pure crude bullions, i.e., bullions which ordinarily contain no more than about 1.3% by weight sulfur as sulfide, or otherwise lack a suitable reagent for the sodium to reduce, by enhancing production of the non-bullion components with their subsequent isolation and recovery.

The introduction of sodium into molten crude bullion and the formation of matte, speiss and bullion equilibrium phase and their subsequent isolation is described in U.S. Pat. No. 4,404,026. The crude bullion described therein is relatively impure, i.e., it contains in excess of about 1.3% by weight sulfur and generally up to as much as 2.6% by weight sulfur as either lead sulfide or copper sulfide. When the sulfur content of the crude bullion is below about 1.3% by weight, however, the introduction of sodium becomes substantially less effective in forming respective isolatable phases, with a bullion phase having an unsatisfactorily high concentration of residual arsenic, and a matte phase having a low copper to lead ratio.

SUMMARY OF THE INVENTION

The present invention is an improvement in a process for concentrating elemental lead in molten crude bullion when the bullion has a sulfur content of not more than 1.3% by weight sulfur as sulfide, and the process comprises introducing sodium into the molten bullion, generally at a temperature of at least about 750° C. but not higher than the boiling point of the sodium, and cooling the molten bullion to solidify a matte phase, a copper speiss phase and a lead bullion phase, the improvement comprising adding previously isolated copper speiss to the molten bullion prior to or substantially simultaneously with the sodium whereby formation and subsequent isolation of the three distinct individual phases is enhanced. The added copper speiss forms a nucleation site for the relatively small amount of speiss which would otherwise form from the equilibrating system, thus promoting the separation of a speiss which is high in copper and arsenic and low in sulfur. The sulfur concentrates in the matte phase while lead is retained in the lead bullion phase. Additionally, the co-added copper speiss is itself refined by the sodium present. The amount of copper speiss needed for carrying out the process is generally in the range of about 6.5 wt. % of the crude bullion.

DETAILED DESCRIPTION OF THE INVENTION

A typical process for purifying crude lead bullion via sodium addition is described in U.S. Pat. No. 4,404,026, the teachings of which are incorporated herein by reference, and comprises casting molten bullion, generally at a temperature of about 1100°–1200° C.; cooling the cast bullion to a predetermined temperature of about 750° C. up to the boiling point of sodium, i.e., about 881° C., thus forming a partial matte crust over the surface of the bullion; introducing a sodium-containing reagent beneath the surface of the bullion pool so as to avoid an oxidation reaction of the sodium with air; then further cooling to solidify the matte and speiss and allow their separation from the lead bullion phase.

Crude lead bullion is obtained from a blast furnace having been separated from ore slag. The composition of a typical crude lead bullion, based on samples from North American commercial lead refiners, is as shown in Table I. The sodium addition process more effectively promotes beneficial separation in crude bullions which have more than 1.3 wt. % sulfur. When less sulfur is present the use of sodium to cause beneficial separation is limited by a lack of suitable reagent for the sodium to reduce and because the minimal production of non-bullion components makes isolation and recovery of those phases difficult. When a distinct speiss phase fails to form or is not isolatable, the bullion phase is poorly refined and retains high arsenic levels.

TABLE I

Composition of a Typical Blast-Furnace Bullion Product (wt. %).

| | | | |
|---|---|---|---|
| Cu | 2.5–5.5 | As | 0.7–1.5 |
| Sb | 0.5–1.75 | S | 0.35–1.6 |
| Ag | 0.2–1.0 | Au | 0.0003–0.0006 |
| Pb | 65–95 | Fe | 0.1–0.8 |
| Zn | 0.05–0.2 | Sn | 0.04–0.17 |
| Bi | 0.1–0.5 | | |

In the formation of the matte, speiss, and lead bullion phases, it is desired that certain elements be concentrated in particular phases in order to enhance the value and simplify further processing of each phase. The introduction of previously isolated copper speiss before or with the sodium enhances the beneficial separation of the matte, speiss, and lead bullion phases. Sulfur concentrates in the matte phase, copper and arsenic concentrate in the speiss phase, and lead concentrates in the bullion phase. The added copper speiss is itself refined by the sodium present, its silver content moving toward the lead bullion phase. The addition of the copper speiss also allows a lower dosage of sodium to be used while effecting a better separation of the equilibrium phases.

Copper speiss may be obtained from a dross reverberatory furnace or as recycle from a sodium addition process. The composition of a typical copper speiss from a dross reverberatory furnace, based on samples from North American commercial lead refiners, is given in Table II.

TABLE II

Composition of a Typical Copper Speiss (wt. %)

| | | | |
|---|---|---|---|
| Cu | 40–60 | As | 12–25 |
| Sb | 0.5–12.0 | S | 0.1–5.0 |
| Ag | 0.1–3.0 | Na | 0.01–0.5 |
| Pb | 5–25 | Fe | 0.5–2.0 |
| Zn | 0.05–1.0 | Sn | 0.10–3.0 |

TABLE II-continued

| Composition of a Typical Copper Speiss (wt. %) | | | |
|---|---|---|---|
| Bi | 0.01–0.10 | Au | 0.0005–0.0100 |

From about 5 wt. % to about 10 wt. % of copper speiss is added to the crude bullion. Not less than 5 wt. % of previously isolated copper speiss should be added according to the invention to promote speiss phase formation. When less than this amount is used, the resulting speiss phase may not be capable of satisfactory isolation. While about 10 wt. % of previously isolated copper speiss, as an upper limit, is a sufficient quantity to promote speiss phase formation according to the invention, more than 10 wt. % may be added to effect its further refinement without adversely affecting speiss phase formation. The copper speiss is combined with the crude bullion prior to the sodium addition. In commercial practice, copper speiss would be added to a cast mold prior to the casting of the crude bullion and thereby effect mixing of the copper speiss with the molten bullion. Alternatively, it may be possible to add the copper speiss at the same time as the sodium.

The amount of sodium required is based on the amount necessary to convert all the sulfur (from PbS), antimony, and arsenic to $Na_2S$, $Na_3Sb$, and $Na_3As$, respectively, and is termed a "stoichiometric sodium requirement". The stoichiometric sodium requirement is reduced by the amount of copper originally present in the crude bullion. The stoichiometric sodium requirement is also reduced by the presence of iron, although the reduction is not generally significant. The suggested level of sodium when co-adding copper speiss is from about 50% up to about 100% of the stoichiometric sodium requirement, although as much as 120% may be used with satisfactory results. Use of sodium in excess of the stoichiometric requirement enhances the fluidity of the matte phase and further enhances speiss formation, but system economics penalize excess sodium use. The use of previously isolated copper speiss allows a lower sodium dosage to effect the phase separation than is required by using sodium alone. The sodium-containing reagent may be metallic sodium, or $Na_2CO_3$, either alone or with coke, or it may be a reagent which is chemically equivalent to a sodium containing reagent, such as, for example, a reactive metal mixture intermediate by-product comprising sodium and calcium of the type described in U.S. patent application Ser. No. 07/693,852, filed May 2, 1991 and allowed Oct. 21, 1991.

The sodium-containing reagent should be added to crude bullion at temperatures above about 750° C. At temperatures below about 750° C. generally not all phases are liquid and phase disengagement can be hampered. When sodium metal is used, it is desirable to add the sodium to the crude bullion at a temperature below about 850° C., preferably at about 800° C., to prevent flashing sodium vapor for both safety and efficiency reasons. As long as the sodium metal is injected beneath the surface of the bullion, temperatures as high as 870° C., but below the boiling point of sodium, i.e., below 881° C., may be feasible because the sodium appears to dissolve quickly in the bullion, and sodium reaction with other species may be rapid compared to loss via volatilization. Other sodium-containing reagents may be added to the crude bullion at higher temperatures because the sodium liberated by the reagent reacts very quickly with the lead bullion. Sodium metal may be added to the crude bullion in the solid or molten state. In either case the sodium metal is injected below the surface of crust which forms on the top of the crude bullion to prevent sodium oxidation with air. When sodium metal is added in the molten state, its temperature is kept below its auto-ignition temperature of 120°–125° C. in accordance with standard handling practices for sodium metal. Sodium-containing reagents, other than sodium metal, would be added to the crude bullion in a manner similar to the procedures used for a reverberatory furnace.

After cooling the treated crude bullion to about 350°–400° C., the matte and speiss phases are separated from the lead bullion phase, usually by mechanical means, for further processing. The lead bullion phase is ready for further refining steps.

EXAMPLE 1

A pyrometallurgical laboratory experiment was conducted in a crucible containing approximately 1394.3 grams of crude bullion the composition of which is shown in Table III. Granulated crude bullion was placed in a graphite crucible and then brought to 800° C. in a stainless steel reactor within an electrically heated furnace. Once test temperature was achieved, a stainless steel probe was lowered such that its tip was below the surface of the melt. Cast rods of sodium metal, a total of 13.3 grams, were injected below the surface of the melt by means of a pure lead slug follower, 66.2 grams, within the injection probe. After injection, the probe was withdrawn and the system was allowed 8 hours to equilibrate at the test temperature. At the completion of the test, the furnace was opened and the reactor system was shock cooled via cold air flow in order to preserve equilibrium phase compositions. After cooling, the test speciment was removed from the crucible, separated into its component phases, and analyzed for composition.

TABLE III

| Crude Bullion (wt. %) | | | |
|---|---|---|---|
| Cu | 4.29 | As | 1.59 |
| Sb | 1.07 | S | 0.346 |
| Ag | 1.04 | Na | 0.014 |
| Pb | 90.90 | Fe | 0.118 |
| Zn | 0.076 | Sn | 0.048 |
| Bi | 0.502 | Au | 0.0032 |

Sodium was added in an amount which was 98% of the stoichiometric amount necessary to react with all sulfur, arsenic, and antimony not already capable of being compounded with the copper present in the crude bullion. This corresponded to 0.90 wt. % sodium in the starting crucible. Table IV records the starting and post-test equilibrium phase compositions.

TABLE IV

| Starting Crucible | | | |
|---|---|---|---|
| Crude Bullion | 1394.3 g | | |
| Sodium Metal | 13.3 g | | |
| Lead Slug | 66.2 g | | |
| Cu | 4.06% | As | 1.50% |
| Sb | 1.01% | S | 0.327% |
| Ag | 0.98% | Na | 0.90% |
| Pb | 90.51% | Fe | 0.112% |
| Zn | 0.07% | Sn | 0.045% |
| Bi | 0.48% | Au | 0.0030% |

| Post-test Equilibrium Crucible | | | |
|---|---|---|---|
| Matte Phase | 16.0 g | | |
| Speiss Phase | 0 g | | |
| Lead Bullion Phase | 1457.8 g | | |
| Matte (wt. %) | | | |
| Cu | 13.8 | As | 3.67 |
| Sb | 0.172 | S | 29.0 |
| Ag | 0.21 | Na | 58.4 |
| Pb | 11.19 | Fe | 4.37 |
| Zn | 5.7 | Sn | 0.033 |
| Bi | 0.107 | Au | 0.00038 |
| Bullion (wt. %) | | | |
| Cu | 3.95 | As | 1.48 |

TABLE IV-continued

| | | | |
|---|---|---|---|
| Sb | 1.02 | S | 0.012 |
| Ag | 0.992 | Na | 0.283 |
| Pb | 91.4 | Fe | 0.065 |
| Zn | 0.01 | Sn | 0.047 |
| Bi | 0.48 | Au | 0.0031 |

After 8 hours the system failed to produce three equilibrium phases. Instead, only a matte phase with relatively high arsenic and lead content was formed above the bullion. The bullion phase remained of poor quality, with most copper and arsenic remaining in that phase. In fact, the lead content of the refined bullion increased from 90.9 wt. % to only 91.4 wt. %, and that was attributed to the pure lead slug used to force sodium into the melt. Any speiss which would have formed was of such a minor amount that it was neither identifiable nor isolatable as the post-test crucible was processed.

Table V gives component distribution between phases and shows that for crude bullions low in sulfur, that the sodium addition process fails to reduce the high level of arsenic in the bullion phase, and yields a matte phase with a low copper value.

TABLE V

| Component Distribution Between Phases (%) | | |
|---|---|---|
| | Matte | Bullion |
| Cu | 3.7 | 96.3 |
| Sb | 0.18 | 99.8 |
| Ag | 0.23 | 99.8 |
| Pb | 0.13 | 99.9 |
| Zn | 86.2 | 13.8 |
| Bi | 0.25 | 99.8 |
| As | 2.64 | 97.3 |
| S | 96.5 | 3.5 |
| Na | 69.5 | 30.5 |
| Fe | 42.6 | 57.4 |
| Sn | 0.77 | 99.24 |
| Au | 0.14 | 99.86 |

EXAMPLE 2

In this Example, copper speiss was used to demonstrate the enhanced phase separation when used in combination with the sodium addition process according to the invention.

Example 2 was carried out in the same fashion as Example 1 with the following exceptions. A sample of the same crude bullion, 1979.1 grams, shown in Table III was used. A total of 15.0 grams of sodium metal and a lead slug of 64.4 grams was used. The copper speiss, 130.6 grams, was mixed with the crude bullion prior to heating. The composition of the copper speiss is given in Table VI. The copper speiss was secured from a reverberatory furnace of a commercial lead refiner.

TABLE VI

| Composition of Copper Speiss (wt. %) | | | |
|---|---|---|---|
| Cu | 53.3 | As | 16.7 |
| Sb | 11.2 | S | 0.771 |
| Ag | 1.467 | Na | 0.172 |
| Pb | 10.4 | Fe | 0.714 |
| Zn | 0.049 | Sn | 0.45 |
| Bi | 0.061 | Au | 0.0074 |

Sodium was added in an amount which was 77.7% of the stoichiometric amount necessary to react with all sulfur, antimony and arsenic not already capable of being compounded with the copper present in the crude bullion. This corresponded to 0.71 wt. % sodium in the starting crucible. Table VII records the starting and post-test equilibrium phase compositions.

TABLE VII

| Starting Crucible | | | |
|---|---|---|---|
| Crude Bullion | 1979.1 g | | |
| Sodium Metal | 15.0 g | | |
| Lead Slug | 64.4 g | | |
| Copper Speiss | 130.6 g | | |
| Cu | 7.06% | As | 2.43% |
| Sb | 1.64% | S | 0.358% |
| Ag | 1.03% | Na | 0.71% |
| Pb | 85.74% | Fe | 0.149% |
| Zn | 0.07% | Sn | 0.064% |
| Bi | 0.46% | Au | 0.0034% |

| Post-Test Equilibrium Crucible | | | |
|---|---|---|---|
| Matte Phase | 31.1 g | | |
| Speiss Phase | 194.3 g | | |
| Lead Bullion Phase | 1963.7 g | | |
| Matte (wt. %) | | | |
| Cu | 7.84 | As | 1.45 |
| Sb | 0.053 | S | 23.8 |
| Ag | 0.05 | Na | 38.3 |
| Pb | 1.9 | Fe | 4.24 |
| Zn | 3.8 | Sn | 0.20 |
| Bi | — | Au | 0.00015 |
| Speiss (wt. %) | | | |
| Cu | 58.4 | As | 22.1 |
| Sb | 6.67 | S | 0.14 |
| Ag | 0.40 | Na | 0.17 |
| Pb | 17.2 | Fe | 1.00 |
| Zn | 0.14 | Sn | 0.18 |
| Bi | — | Au | 0.0038 |
| Bullion (wt. %) | | | |
| Cu | 1.96 | As | 0.50 |
| Sb | 1.16 | S | 0.01 |
| Ag | 1.08 | Na | 0.167 |
| Pb | 94.0 | Fe | 0.001 |
| Zn | 0.003 | Sn | 0.059 |
| Bi | — | Au | 0.0033 |

After equilibrium, three well defined phases formed. The speiss phase weighed 63.7 grams more than the speiss originally charged to the system. This indicated both a preservation of the co-added speiss and an augmentation of its mass as it provided a nucleation site for additional speiss formation. The added copper speiss appears to have been refined by the action of the sodium as well. Speiss phase copper and arsenic levels have increased, while silver, gold, and antimony levels have fallen. The refined bullion phase is of higher purity (i.e. it has a greater wt. % lead) than in the example in which copper speiss was not used. Additionally, the arsenic and copper levels of the lead bullion phase were significantly reduced.

Table VIII gives the component distribution between phases and shows, by the use of copper speiss in the sodium addition process to treat crude bullions low in sulfur, that arsenic and copper concentrate in the speiss phase, while the sulfur concentrates in the matte phase.

TABLE VIII

| Component Distribution Between Phases (%) | | | |
|---|---|---|---|
| | Matte | Speiss | Bullion |
| Cu | 1.58 | 73.5 | 24.9 |
| Sb | 0.045 | 36.4 | 63.6 |
| Ag | 0.07 | 3.54 | 96.38 |
| Pb | 0.031 | 1.78 | 98.2 |
| Zn | 78.2 | 17.85 | 3.98 |
| Bi | 0.06 | 1.93 | 98.0 |
| As | 0.84 | 80.8 | 18.3 |
| S | 94.1 | 3.43 | 2.49 |
| Na | 76.76 | 2.10 | 21.15 |
| Fe | 40.2 | 59.2 | 0.60 |
| Sn | 4.02 | 21.85 | 74.15 |
| Au | 0.06 | 10.21 | 89.70 |

We claim:

1. In a process for concentrating elemental lead in crude lead bullion which has a sulfur content of less than about 1.3% by weight and comprises introducing sodium into the molten crude lead bullion and cooling the bullion to solidify and isolate a matte phase and a copper speiss phase from a lead bullion phase, the improvement comprising adding previously isolated copper speiss to the molten bullion prior to or substantially simultaneously with the sodium whereby formation of the three distinct phases is enhanced.

2. The process of claim 1 in which at least about 5% by weight, based on the original amount of crude lead bullion, of previously isolated copper speiss is added to the molten bullion.

3. An improved process for concentrating elemental lead in molten crude lead bullion which contains not more than 1.3% by weight sulfur as sulfide which comprises:

(a) forming a pool of the molten crude lead bullion and then cooling it to a temperature sufficient to form a partial matte crust covering the surface thereof;

(b) introducing sodium into the molten bullion;

(c) cooling the molten bullion to a solidification temperature at which a distinct matte phase, a copper speiss phase and a lead bullion phase is formed; and (d) combining at least about 5% by weight, based on the amount of crude bullion, of previously isolated copper speiss with the molten bullion either prior to step (a) or substantially simultaneously with step (b).

4. A process as claimed in claim 1 wherein the previously isolated copper speiss has the following composition (by weight):

| | | | |
|---|---|---|---|
| Cu | 40–60 | As | 12–25 |
| Sb | 0.5–12.0 | S | 0.1–5.0 |
| Ag | 0.1–3.0 | Na | 0.01–0.5 |
| Pb | 5–25 | Fe | 0.5–2.0 |
| Zn | 0.05–1.0 | Sn | 0.10–3.0 |
| Bi | 0.01–0.10 | Au | 0.0005–0.0100 |

* * * * *